United States Patent [19]

Williams, Curtis

[11] 4,205,416

[45] Jun. 3, 1980

[54] TILT RELEASE CATCH

[76] Inventor: Williams, Curtis, 200 Center Plz., Tulsa, Okla. 74119

[21] Appl. No.: 881,536

[22] Filed: Feb. 27, 1978

[51] Int. Cl.[2] ..... A44B 11/25; A44B 11/12

[52] U.S. Cl. ..... 24/230 TC; 24/191

[58] Field of Search ..... 24/230 A, 191, 230 TC, 24/170

[56] References Cited

U.S. PATENT DOCUMENTS

| | | | |
|---|---|---|---|
| 211,594 | 1/1879 | Schofield | 24/191 |
| 635,331 | 10/1899 | Malins | 24/191 |
| 1,582,362 | 5/1926 | West | 24/230 A |
| 2,110,684 | 3/1938 | Schuhmann | 24/77 R |
| 2,876,516 | 3/1959 | Cummings | 24/230 A |
| 3,091,010 | 5/1963 | Davis | 24/230 A |
| 3,233,941 | 2/1966 | Selzer | 24/230 A |
| 3,370,329 | 2/1968 | Takada | 24/230 A |
| 3,883,932 | 5/1975 | Meiller | 24/230 A |

FOREIGN PATENT DOCUMENTS

| | | | |
|---|---|---|---|
| 100998 | 1/1899 | Fed. Rep. of Germany | 24/191 |
| 755139 | 11/1933 | France | 24/230 A |
| 1400403 | 7/1975 | United Kingdom | 24/191 |

*Primary Examiner*—Alexander Grosz

*Attorney, Agent, or Firm*—Head & Johnson

[57] ABSTRACT

A tilt release catch comprises a housing member with an opening to receive a male member and the passage of belting completely therethrough, a dog adaptively mounted in the side walls of the housing, a spring of sufficient strength to keep the blade of the dog in a position to catch the blade slot of the male member when the male member is forced between the dog and the inside of the rear wall of the housing, said male member adaptively formed with a stud which depresses the dog and spring when tilted upon them. This catch desirably includes a slot for the belt to which it is attached in use.

4 Claims, 6 Drawing Figures

TILT RELEASE CATCH

BACKGROUND OF THE INVENTION

An object of this invention is the provision of a catch which will allow instant escape from a vehicle if used as a seat belt buckle, or instant release of cargo is used as a cargo buckle. When used as a seat belt, this catch can be adjusted to release with the slap of a hand or the push of an arm struggling to be freed. The advantages of this characteristic can be easily seen—in many accidents survival depends in escaping the vehicle instantly, i.e., if it is burning or about to fall from an escarpment.

This adjustment is determined by the producer in advance of fabrication. By elevating the stud further from the bottom of the male member, more tilt is required to depress the dog and spring and thereby release the male member; also by shortening the stud the same objective is accomplished. Whether the mechanism is adjusted for hair-trigger release or for deliberate release, it is a faster release than that available is conventional button release seat belts.

SUMMARY OF THE INVENTION

The preferred embodiment of this invention includes a housing provided with a seat for a spring and means to secure a pivoting dog within the walls of the housing, said dog having an extension or lever portion beyond and outside of the housing by which the spring may be depressed, and also a securing and pivoting means within the side walls of the housing which allow for the seating of the dog adaptively so that the blade of the dog is constantly pressed by the spring against the inside of the rear wall. Said dog may be pivoted by its lever portion to depress the spring, or its blade may be displaced by the insertion of the male member between blade and rear wall until the blade slot of the male member is caught by the blade and the male member is held within the housing. The male member is released when it is tilted inward until its stud displaces the dog and spring, removing the blade from the blade slot. The housing must be provided with means such as a slot to hold the belt to which it is usually appended, unless it is anchored in other fashion which is also comprehended in this concept. In the preferred model, the slot flange is an integral part of the rear wall, and it is supported by the side walls; whereas, in other models the flange may be simply an extension of the rear wall and not so supported. Also in the preferred model, the flange wall is recessed so that belting looped through the slot will not interfere with belting coming through the housing. In this model both the top and the bottom of the housing are open in part to allow the passage either of the male member of belting.

In the lower opening used primarily for belting but adaptable for an extended male member, a curved belt guide is provided so that a user who wishes to tighten a load by pulling the belt is assisted in so doing, and the dog length is adapted not to interfere with this action, but to rest against the upper portion of the belt guide, an extension of the front wall.

Figure 5:
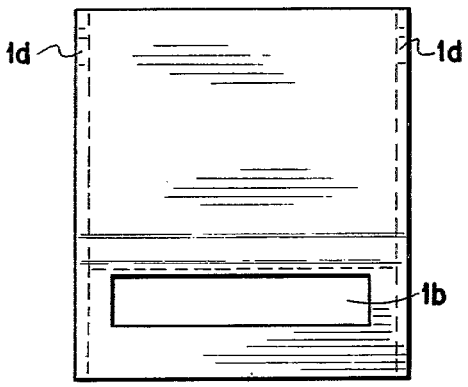
FIG. 5 is a rear view in elevation of the housing.
Figure 1:
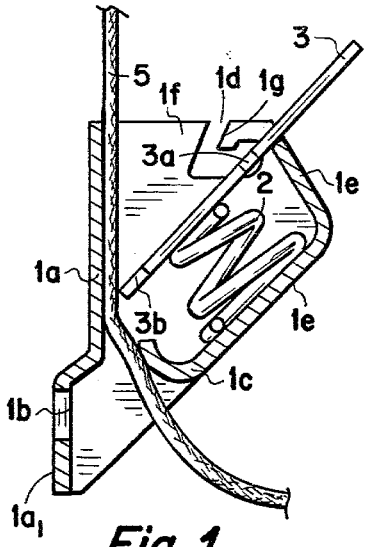
FIG. 1 is a cross-sectional view of the catch inside elevation.
Figure 3:
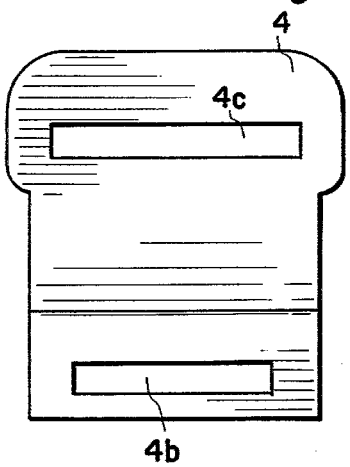
FIG. 3 is a front view in elevation of the male member.
Figure 2:
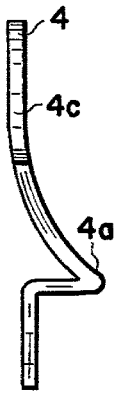
FIG. 2 is a side view in elevation of the male member.
Figure 4:
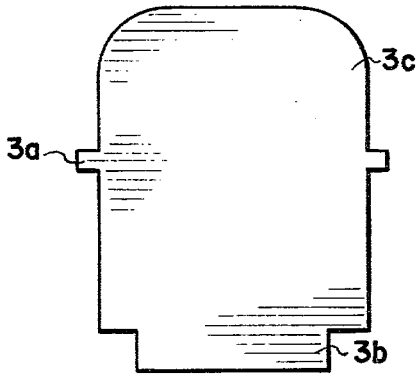
FIG. 4 is a plan view of the dog.
Figure 6:
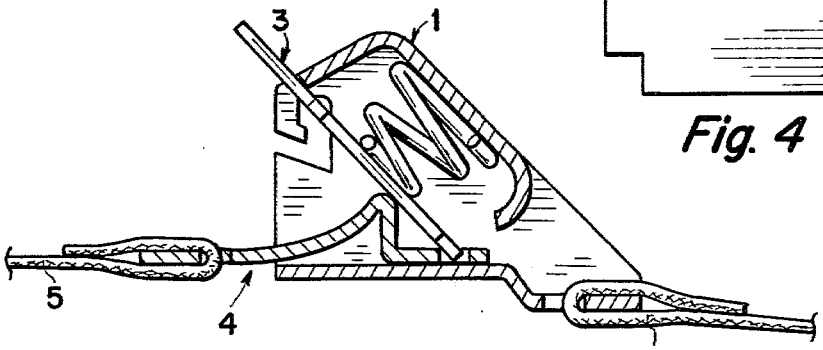
FIG. 6 is a sectional elevational view of a catch embodying the invention and illustrating the tongue in an operative position within the housing.

As may be seen from the drawings, the housing is generally designated by the number 1, and it comprises the rear wall 1*a*, which extends into a recessed slot flange 1*a*1, which is provided with belt slot 1*b* for receiving one end of a suitable belt 5, or the like, therethrough as is well known. Front walls 1*e* extend into and are integral with belt guide 1*c*, and side walls 1*f* are provided with dog support 1*d* and baffle 1*g* which seats dog pivot 3*a*. A conventional spring is designated by the number 2. As may be seen from the drawings, the dog is generally designated by the number 3, and comprises the pivot 3*a*, the blade, 3*b*, and the lever, 3*c*.

It should also be clear that the male member is generally designated by the number 4, and it comprises a stud 4*a*, a blade slot 4*b*, and a belt slot 4*c* for receiving the opposite end of the belt 5 therethrough, as is well known.

I claim as my invention:

1. A tilt release catch comprising a housing member having at least one wall thereof disposed at an acute angle with respect to an opposite side wall, a dog member pivotally supported in the housing, a helical spring interposed between the angularly disposed wall and the dog member for constantly urging the dog member in a direction toward said opposite side wall, a male member adapted for insertion between the dog member and said opposite side wall and having an aperture for receiving one end of the dog member in a locking position therebetween, and a stud member provided on the male member for selective engagement with the dog member for releasing the engagement of the male member therefrom.

2. A tilt release catch as set forth in claim 1 wherein the dog member comprises a plate member having a pair of oppositely disposed pivot members extending outwardly from the sides thereof for engagement with complementary apertures provided in the housing, a blade member at one end of the plate for releasable engagement with the aperture of the male member, and a release flange at the opposite end of the plate for manual engagement to pivot the dog member in a direction for release of the dog from the male member to provide a second means for release of engagement between the dog member and the male member.

3. A tilt release catch as set forth in claim 1 wherein the housing is provided with an aperture flange member for securing the housing to a strap means, and the male member is provided with an apertured flange member for securing the male member to a complementary strap means.

4. A tilt release catch comprising a housing member, a dog member pivotally supported by the housing member and having one end thereof extending into the interior of the housing and one end thereof protruding exteriorly of the housing, a helical spring member disposed within the housing and bearing against the dog member for constantly urging the dog member in a direction for engagement of the inner end thereof with the inner periphery of the housing, a male member removably insertable within the housing between the dog member and the inner periphery of the housing and having an aperture for receiving the inner end of the dog member therein, a stud member provided on the male member and selectively engageable with the dog member for moving the dog member against the force of the spring for releasing the engagement between the dog and the male member, and said exterior end of the dog member being manually engagable for pivoting the dog member in a direction against the force of the spring to provide a second means for releasing the engagement between the dog member and the male member.

* * * * *